US005657418A

United States Patent [19]

Gerson et al.

[11] Patent Number: 5,657,418

[45] Date of Patent: Aug. 12, 1997

[54] PROVISION OF SPEECH CODER GAIN INFORMATION USING MULTIPLE CODING MODES

[75] Inventors: Ira Alan Gerson, Hoffman Estates; Mark Antoni Jasiuk, Chicago, both of Ill.

[73] Assignee: Motorola, Inc., Schaumburg, Ill.

[21] Appl. No.: 755,393

[22] Filed: Sep. 5, 1991

[51] Int. Cl.[6] ..... G10L 9/02

[52] U.S. Cl. ..... 395/2.16; 395/2.32

[58] Field of Search ..... 381/29–36; 395/2, 395/2.16, 2.17, 2.18, 2.23, 2.32

[56] References Cited

U.S. PATENT DOCUMENTS 4,074,069 2/1978 Tokura ..... 381/38

4,791,654 12/1988 De Marca ..... 381/29

4,933,957 6/1990 Bottau ..... 381/29

*Primary Examiner*—David D. Knepper

*Attorney, Agent, or Firm*—Steven G. Parmelee; Christopher P. Moreno

[57] ABSTRACT

In a speech coder (100), excitation source gain information (802) is transmitted along with a coding mode indicator. The coding mode indicator indicates how the gain information is to be interpreted. In one embodiment, the coding mode indicator can also be utilized to control which of a plurality of excitation sources (202, 206–208) are utilized when synthesizing the speech. The coding mode itself is selected as a function of the periodicity of an input speech signal.

14 Claims, 4 Drawing Sheets

PROVISION OF SPEECH CODER GAIN INFORMATION USING MULTIPLE CODING MODES

FIELD OF THE INVENTION

This invention relates generally to speech coding, including but not limited to preparation of excitation source gain information for transmission, and receiving such information.

BACKGROUND OF THE INVENTION

Communication resources such as radio frequency channels are, at least at the present time, limited in quantity. Notwithstanding this limitation, communication needs continue to rapidly increase. Dispatch, selective call, and cellular communications, to name a few, are all being utilized by an increasing number of users. Without appropriate technological advances, many users will face either impaired service or possibly a complete lack of available service.

One recent technological advance intended to increase the efficiency of data throughput, and hence decrease system capacity needs to thereby allow more communications to be supported by the available limited resources, is speech coding. Code Excited Linear Prediction (CELP) speech coders and Vector Sum Excited Linear Prediction (VSELP) speech coders (the latter being a class of CELP coders) have been proposed that exhibit good performance at relatively low data rates. Rather than transmitting the original voice information itself, or a digitized version thereof, such speech coders utilize linear prediction techniques to allow a coded representation of the voice information to be transmitted instead. Utilizing the coded representation upon receipt, the voice message can then be reconstructed. For a general description of one version of a CELP approach, see U.S. Pat. No. 4,933,957 to Bottau et al., which describes a low bit rate voice coding method and system.

CELP type speech coders derive an excitation signal by summing a long term prediction vector with one or more codebook vectors, with each vector being scaled by an appropriate gain prior to summing. A linear predictive filter receives the resultant excitation vector and introduces spectral shaping to produce a resultant synthetic speech. Properly configured, the synthetic speech provided by such a speech coder will realistically mimic the original voice message.

As just mentioned, the excitation vectors are scaled by an appropriate gain prior to summing. These gains are typically originally calculated at the time of coding the speech, and are then transmitted to the receiver that will synthesize the speech as described above. Various methods of gain quantization prior to such transmission are used in the art, including scalar quantization and vector quantization (the latter being more efficient). The bits used to code this gain information are sensitive to bit errors. If the gain values are decoded incorrectly due to channel errors, the error, in addition to detrimentally affecting the current subframe's excitation, will propagate forward in time as well since the corrupted excitation vector will also be fed into the long term prediction state for later use in developing subsequent long term prediction vectors.

One helpful method for quantizing such gains for low data rate speech coders is described in the article "Vector Sum Excited Linear Prediction (VSELP) Speech Coding at 8KBPS," by Ira Gerson and Mark Jasiuk, which article appears in The Proceedings of the International Conference On Acoustics, Speech and Signal Processing, at pages 461–464, as published in April of 1990 (the contents of which are incorporated herein by this reference).

Notwithstanding the improvements offered by the teachings in the above reference, a method to more efficiently code the gain values, while simultaneously reducing the sensitivity of the gain bits to errors, is needed. This need is driven by three particular demands. First, there is a continued need to reduce speech coder data rates. Second, there is a need to maintain (or improve) good speech quality. Third, there is a need to design in robustness to channel errors. These three requirements are often critical to success in speech coder applications.

SUMMARY OF THE INVENTION

These needs and others are substantially met through provision of a method for providing information, such as gain information, by first providing a plurality of coding modes for speech coding input speech samples, wherein at least two of the coding modes correspond to at least substantially voiced input speech signals, and by then selecting one of the coding modes as a function, at least in part, of periodicity of the input speech signal.

In one embodiment, this method utilizes pitch related information as corresponds to an input speech signal for a plurality of coding subframes. Based upon this information, error information is developed on a subframe by subframe basis, which error information reflects the periodicity of the input speech signal. Based upon this periodicity, one of the coding modes is then selected and subsequently utilized to provide coding of gain quantization for the excitation sources.

In one embodiment, at least one of the coding modes may correspond to a primarily unvoiced input speech signal.

In another embodiment of the invention, a plurality of excitation sources can be provided, which excitation sources can include both VSELP excitation codebooks and at least one excitation source that represents pitch related information. Selection of these excitation sources for use in synthesizing speech for a particular frame can be directed by a coding mode indicator, which coding mode indicator is developed in the same manner as set forth above.

DESCRIPTION OF A PREFERRED EMBODIMENT

Figure 1:
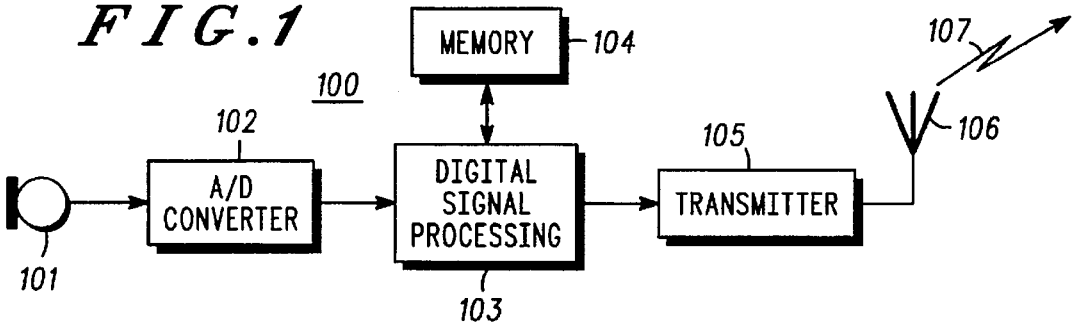
FIG. 1 comprises a block diagram depiction of a speech coder and transmitter in accordance with the invention.

A radio transmitter having speech coding capabilities in accordance with this invention can be seen in FIG. 1 as generally depicted by reference numeral 100. A microphone (101) receives an acoustically transmitted speech signal input. An analog to digital convertor (102) receives an electrically transduced analog version of this input signal and renders a digital representation thereof at an output. A digital signal processor (103), such as a DSP 56000 family device (as manufactured and sold by Motorola, Inc.) receives this digitized representation and performs a variety of functions, including coding of the speech information and framing of this coded information in preparation for transmission. (The speech coding presumed used in this embodiment constitutes the CELP class speech coding known as vector sum excited linear prediction (VSELP) speech coding, though the benefits of the invention described herein may be attained with other speech coding platforms as well.) A memory (104) couples to the digital signal processor (103), and retains various elements of information utilized by the digital signal processor (103) when performing the above noted functions.

The output of the digital signal processor (103) couples to a transmitter (105), which utilizes the framed speech coding information as a modulation signal for a radio frequency carrier signal (107) that radiates from an antenna (106).

All of the above components, both individually and in the configuration depicted, are well known and understood in the art. Therefore, additional explanatory material will not be provided here. In order to ensure a more detailed understanding of this invention, however, additional descriptive information will be provided regarding the VSELP voice synthesizing process.

Figure 2:
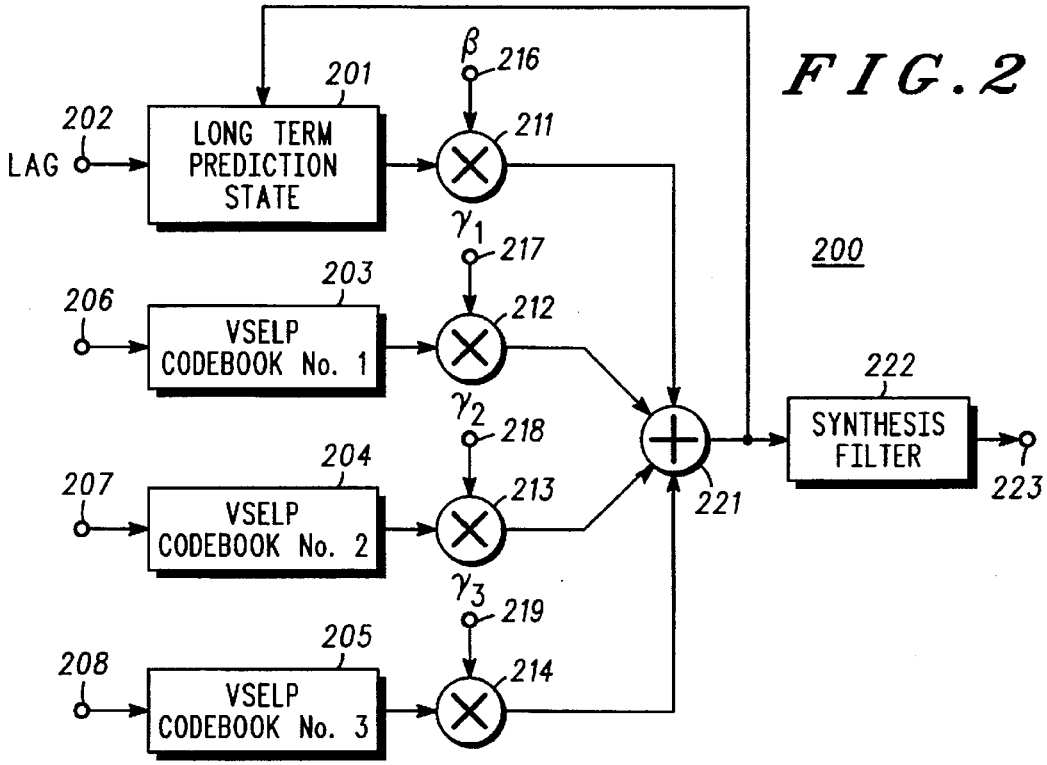
FIG. 2 comprises a block diagram depiction of a pertinent aspect of a speech coder in accordance with the invention.

In FIG. 2, a block diagram depicts a VSELP speech synthesis platform (200). (Those skilled in the art will recognize that the block diagram depicted is representative of the functioning of the digital signal processor (103), and that the particular functions and signal routing depicted are accomplished through appropriate programming of the digital signal processor itself, all in accordance with well understood prior art technique.)

To provide a digitized representation of synthesized speech (223), a synthesis filter (222), such as a linear predictive filter, spectrally shapes an input excitation signal. (The manner by which this shaping occurs is understood in the art, and will not be repeated here.) This excitation signal typically comprises the sum (221) of two or more excitation sources. Typical prior art platforms will provide a long term prediction state and one or two other codebooks. In this particular embodiment, one long term prediction state (201) and three VSELP codebooks (203–205) are provided, though only two of the above are typically used at any given moment.

To produce an excitation signal from these excitation sources, an appropriate enabling input must be provided. As well understood in the art, the long term prediction state (201) receives lag information (202), while the VSELP codebooks (203–205) receive an input (206–208) that designates particular codebook entries. The resultant excitation signals are then scaled (211–214) by gain factors (216–219).

The gain factors (216–219) are determined during the initial voice coding process, and provided to the speech synthesizing platform depicted here, along with other relevant speech coding information, such as the lag information (202) and synthesis filter (222) settings. (More will be said regarding these gains (216–219) below, as this invention is particularly concerned with providing this gain information in a manner that is particularly sparing of coding requirements, supports good speech quality, and is relatively robust during channel traversal.)

The resultant scaled excitation signals are then summed and provided to the synthesis filter (222) as an excitation source. In addition, the resultant excitation signal feeds back to the long term prediction state (201) to update the state. As noted earlier, an error in gain (216–219) will not only result in an immediately distorted synthesized speech output, but will also propagate forward in time, since the long term prediction state (201) will be basing subsequent excitation signal production on the corrupted excitation signal as well.

Figure 3:
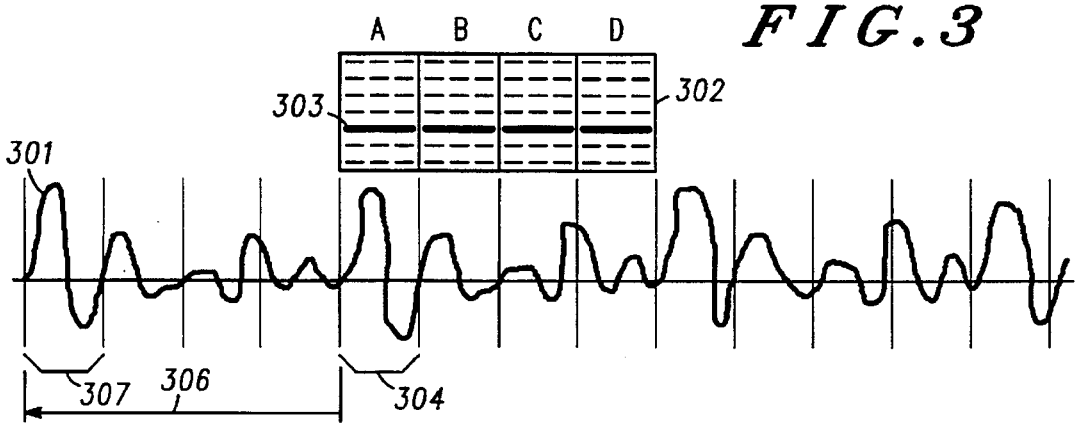
FIG. 3 comprises a diagrammatic depiction of a speech signal in representative juxaposition with respect to a coding frame in accordance with the invention.

It may be helpful to the reader to more fully understand the lag parameter (202) as provided to the long term prediction state (201), since that parameter constitutes a basis, in this embodiment, for selecting a particular coding mode for the excitation source gains (216–219). Referring to FIG. 3, an illustrative input speech signal (301) can be seen as parsed into a plurality of segments, each segment representing a predetermined period of time, such as 5 ms.

In this embodiment, speech coding information is provided on a frame by frame basis, with each frame containing four subframes (A–D). Each subframe represents a segment of the original speech information (301). For example, subframe A represents the segment denoted by reference numeral 304. In addition to other information contained in each subframe appropriate to provide a coded representation of the speech information (301), each subframe also includes a lag parameter, which lag parameter may be any of a plurality of discrete levels. As depicted, subframe A has a lag parameter value as denoted by reference numeral 303. This lag value (303) represents a period of time (306) prior to the subframe A segment (304) where the long term prediction state (201) can locate an earlier processed segment (307) that substantially conforms to the information contained in the current segment (304).

Speech, and particularly voiced speech, tends towards periodicity. This being the case, significant coding benefits are attained by sending such lag information each subframe, since typically a similar pitch representation can be found in recent history that will serve the needs of the speech synthesizer.

The use of lag information for the above described purpose, and the manner of selecting such lag information, is generally understood in the art. What is particularly important here, however, is that the lag information as initially calculated in the transmitting speech coder also functions, when viewed appropriately, to reflect periodicity of the input signal (periodicity in turn typically reflecting the degree of voicing in the speech sample itself). In particular, when selecting the lag values for each subframe, the speech coder can readily determine an error value representing how well (or how poorly) the selected lag value identifies a recent history sample that correlates well with the present sample. When only small errors are found, a high degree of periodicity is apparent. Conversely, when more significant errors are present, less periodicity is present as indicated by the fact that a recent history sample cannot be found that correlates well with the present sample. (The manner by which this error is calculated, and then utilized to support the intentions of this invention, will be provided below.)

Figure 4:
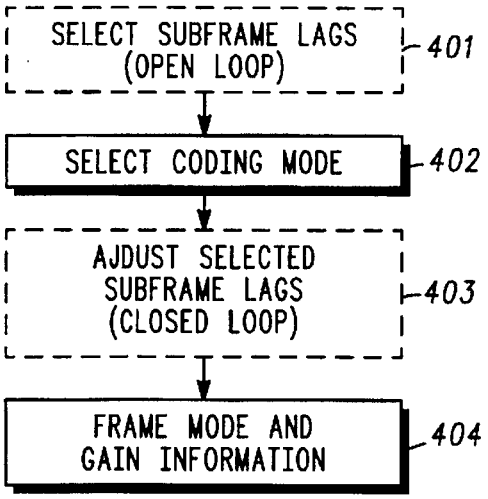
FIG. 4 comprises a flow diagram depicting processing in accordance with the invention.

To completely encode a particular speech sample entails a large number of steps, most of which are not particularly relevant to an understanding of this particular invention. The applicant has determined a particularly advantageous point during the coding process at which the embodiment described herein may be practiced. To place that point in context, the reader is now referred to FIG. 4. As noted earlier, the speech encoding process requires that, at some point, lag information be selected for each subframe. In a copending patent application entitled "Delta-Coded Lag Information For Use In A Speech Coder" (filed on the same date as the present application and commonly assigned herewith to Motorola, Inc.), the applicants describe a lag value selection process that includes both an open-loop process and a subsequent closed-loop process. The applicant advises that, subsequent to the selection of lag information for each subframe pursuant to the open-loop process (401), a gain coding mode then be selected (402) as described below, following which the lag adjustment process pursuant to the closed-loop process can continue (403) for all subframes. Following this (and following completion of determining all other speech coding information), the gain and mode information can then be framed along with other speech coding information (404), as also described below in more detail.

Figure 5:
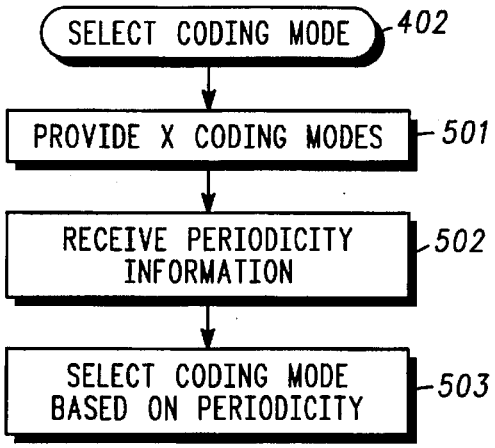
FIG. 5 comprises a flow diagram depicting processing in accordance with the invention.

With reference to FIG. 5, this coding mode selection process (402) first provides for a plurality of coding modes (501). Although any desired number of coding modes can be provided, in the present embodiment, the applicants have selected four (these coding modes will be described in more detail below). Generally speaking, the process then receives information reflecting the periodicity of the speech signal (502), and selects one of the coding modes based on this periodicity (503). Effectively, this method achieves its goal of reducing the number of bits used for quantizing excitation source gain information, decreasing the sensitivity of the gain bits to channel errors, and maintaining good speech quality by essentially classifying a speech frame (using the degree of voicing as the criterion), and utilizing a particular gain quantizer for each class.

Figure 6:
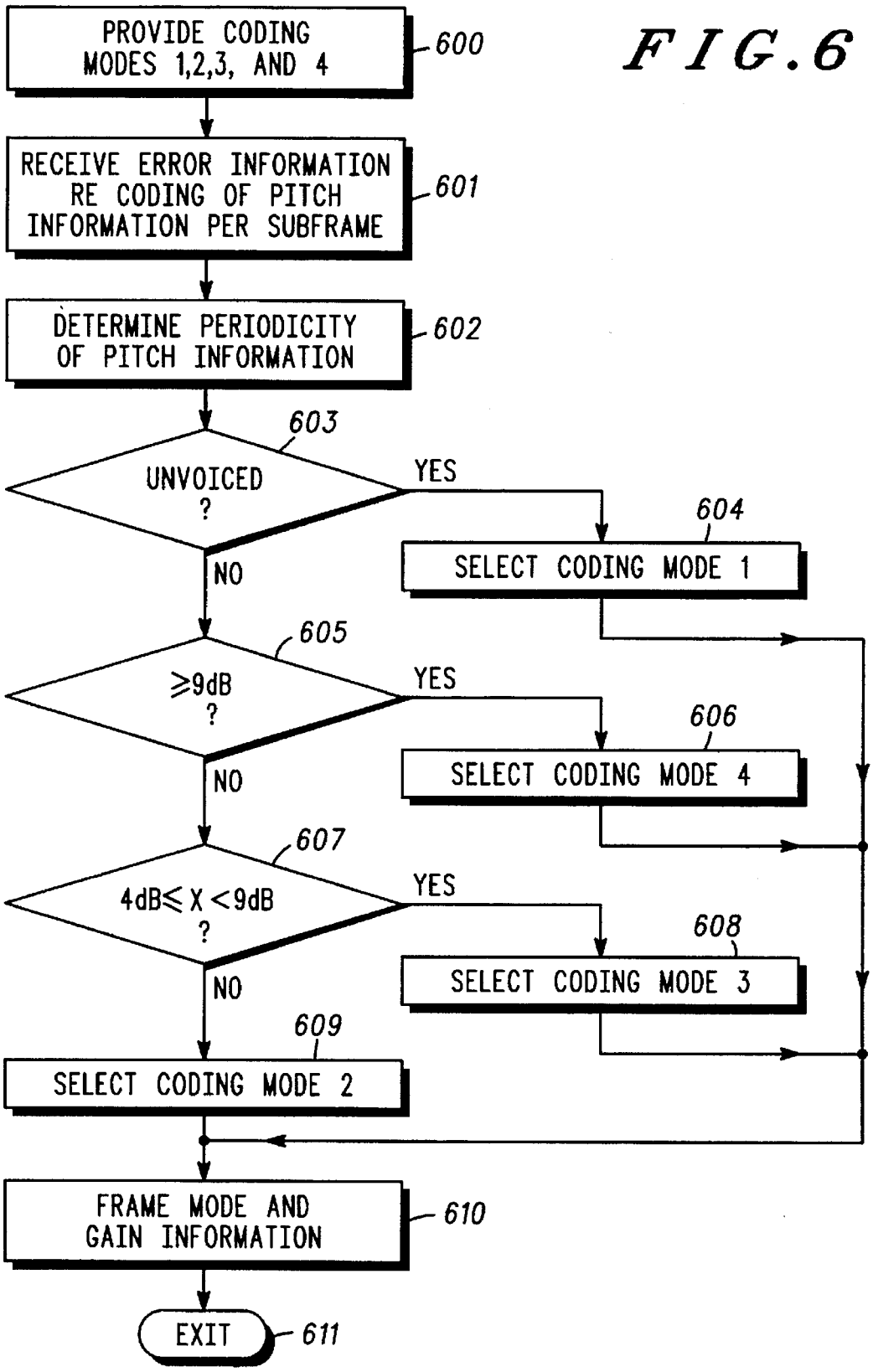
FIG. 6 comprises a flow diagram depicting processing in accordance with the invention.

Referring now to FIG. 6, the above generally referred to steps will now be described in greater detail.

Figure 7A:
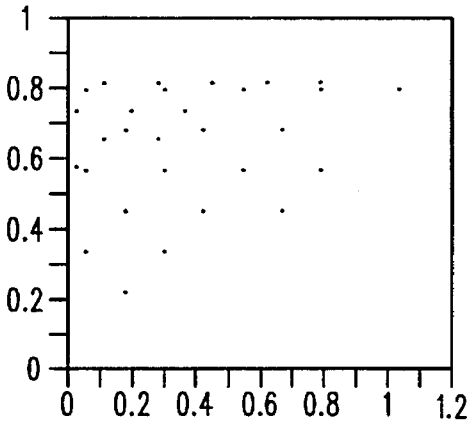
FIGS. 7A–D depict graphs illustrating representative vector quantized gain information for each of four coding modes in accordance with the invention.
Figure 7B:
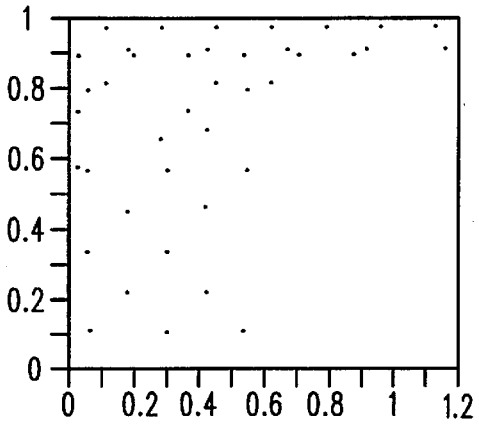
Figure 7C:
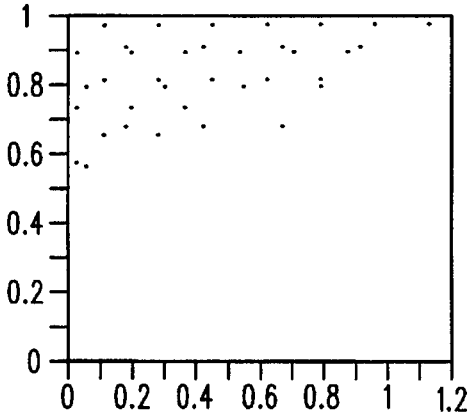
Figure 7D:
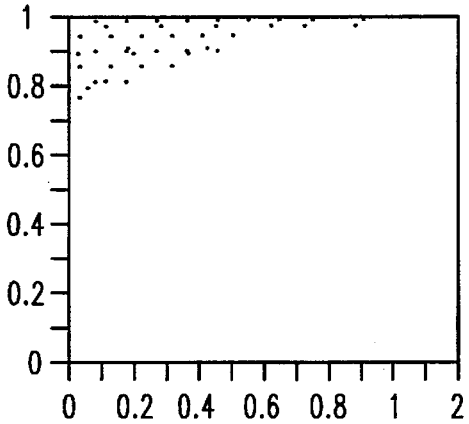

To begin, four coding modes are provided (600). These coding modes will now be described with momentary reference to FIG. 7A–D. FIG. 7A represents coding mode 1, FIG. 7B represents coding mode 2, FIG. 7C represents coding mode 3, and FIG. 7D represents coding mode 4. Coding mode 1 (FIG. 7A) is appropriate for use in representing the gain information of primarily unvoiced speech. Conversely, coding mode 4 (FIG. 7D) represents gain quantization coding appropriate for use with primarily voiced speech. Coding modes 3 and 2 are for use with progressively less voiced speech, respectively.

The vertical axis of each graph depicted in (FIGS. 7B–D) represents that part of total excitation that is due to the long term prediction state component. The horizontal axis for all of the graphs depicted represents a scaling factor to allow adjustment of an average frame energy value for each subframe (which average frame energy value is sent at the frame rate). In the coding mode for unvoiced speech (FIG. 7A), the vertical axis represents that portion of excitation which is due to a particular pre-identified VSELP codebook.

Each coding mode provides 32 index points (with only a few of these 32 index points being depicted here for purposes of clarity). Each index point corresponds to a related horizontal axis and vertical axis value. By selecting one of the index points, and representing this index point as a 5 bit expression, a gain quantized value is thereby available for inclusion in the relevant subframe. The receiver, of course, can reverse the process to determine the particular gain values to be applied to the excitation source signals. (The precise manner in which the relevant gain information can be extracted at the receiver is described in detail in copending U.S. Ser. No. 422,927, filed Oct. 17, 1989, titled "Digital Speech Coder Having Optimized Signal Energy Parameters", by Ira Gerson and Mark Jasiuk.) So configured, this 5 bit field in each subframe will represent a first set of quantized gain values when decoded with respect to, for example, coding mode 2 (FIG. 7B), and will represent a different set of quantized gain values when compared to the values that will result when decoded with respect to, for example, coding mode 4 (FIG. 7D). Consequently, fewer bits are required to ultimately represent a wide variety of gain quantized values, since these same 32 indexes can each represent any of four specific gain quantized values by referring to a particular coding mode. The latter result constitutes an important benefit of this embodiment.

Referring again to FIG. 6, the process next receives error information regarding the coding of pitch information on a subframe by subframe basis (601). More particularly, let x(n) be the spectrally weighted input speech, blocked into subframes that each consist of N samples. M subframes constitute a frame (here, there are four subframes per frame, though of course this value can vary as desired). In addition, assume that each subframe has associated with it a long term predictor lag value $L_i$ where $_i$ is an index to the subframe within the frame. $L_i$ is the delay, in samples, which for voiced speech typically corresponds to the pitch period or a multiple of the pitch period, as discussed generally above with respect to FIG. 3. Given x, subframe index i, and $L_i$, the open-loop long term prediction gain at the ith subframe may be calculated. Define $e_i$ (n) to be the optimal error sequence at the ith subframe, for n=1, N, where x(1) is the first sample in the frame, as follows:

$$e_i(n)=x(n+(i-1)N)-\gamma_i x(n+(i-1)N-L_i),\ \text{for } n=1,N$$

The optimal error energy at the ith subframe $E_i$ is defined as:

$$E_i=\sum_{n=1}^{N} e_i2(n)$$

$E_i$ is a function of x, i, $L_i$, and $\gamma_i$. $\gamma_i$ is the optimal first order long term prediction coefficient for the ith subframe, and is computed by setting the partial derivative $E_i$ with respect to $\gamma_i$ equal to zero in solving the resulting equation.

$$\frac{\partial E_i}{\partial \gamma_i}=0$$

$\gamma_i$ is given explicitly by:

$$\gamma_i=\frac{\sum_{n=1}^{N} x(n+(i-1)N)x(n+(i-1)N-L_i)}{\sum_{n=1}^{N} x^2(n+(i-1)N-L_i)}$$

In other words, $e_i$ (n) is the error sequence left after optimal first order prediction of the sequence x(n+(i–1)N) by the sequence x(n+(i–1)N–$L_i$). The more similar (i.e., periodic) the two sequences are, the smaller the reconstruction error sequence $e_i$(n) will be. An alternate interpretation is that $e_i$(n) is the sequence which must be added to $\gamma_i$ x(n+(i–1)N–$L_i$) to reconstruct x(n+(i–1)N) perfectly. In equation form:

$$x(n+(i-1)N)=\gamma_i x(n+(i-1)N-L_i)+e_i(n), \text{ for } n=1,N$$

Define $S_i$ to be the input signal energy at the ith subframe:

$$S_i=\sum_{n=1}^{N} x^2(n+(i-1)N)$$

The ratio of $S_i$ to $E_i$ is indicative of the degree of similarity (periodicity) present at the ith subframe, when x(n+(i−1)N) is compared to x(n+(i−1)N−$L_i$) for n=1,N. This ratio may be expressed in dB as the open-loop long term prediction gain for the ith subframe, as given by this equation:

$$P_i=10\log_{10}\left[\frac{S_i}{E_i}\right]$$

Similarly, the open-loop prediction gain for the frame may be expressed as:

$$P_f=10\log_{10}\left[\frac{\sum_{i=1}^{M} S_i}{\sum_{i=1}^{M} E_i}\right]$$

Therefore, the following values are available: $P_i$ for each subframe (these being the subframe open-loop long term predictor prediction gains) and $P_f$ (this being the frame open-loop long term predictor prediction gain), all as expressed in dB. The $P_i$ values indicate the degree of periodicity at each subframe, while $P_f$ indicates the degree of periodicity present in the entire frame. The higher the dB prediction gain, the more periodic the signal. For example, a strongly voiced (quasi-periodic) subframe of sampled speech might yield a $P_i$ greater than 10 dB. A frame that is not voiced is likely to have a $P_f$ less than 2 dB.

Using this information, the process can determine the periodicity of the pitch information (602), since the $P_i$ and $P_f$ information represents a degree of periodicity present in the input signal within the frame. Based upon this periodicity information, the process selects one of the four coding modes described above. For example, if the periodicity information indicates that $P_f$ is less than 2 dB, thereby reflecting a primarily unvoiced frame (603), coding mode 1 is selected (604). If, however, $P_i$ is greater than or equal to 9 dB, for all i (i=1,M), thereby indicating a primarily voiced frame (605), coding mode 4 is selected (606). If $P_i$ is greater than or equal to 4 dB for all i (i=1,M), but $P_i$ is less than 9 dB at any one of the M subframes, thereby indicating at least substantially voiced frame information (607), coding mode 3 is selected (608). Lastly, when $P_f$ is greater than or equal to 2 dB and any of $P_i$ is less than 4 dB, thereby indicating a mixed voicing mode, coding mode 2 is selected (609).

The mode and gain information is then framed (610) and the process concluded (611).

Figure 8:
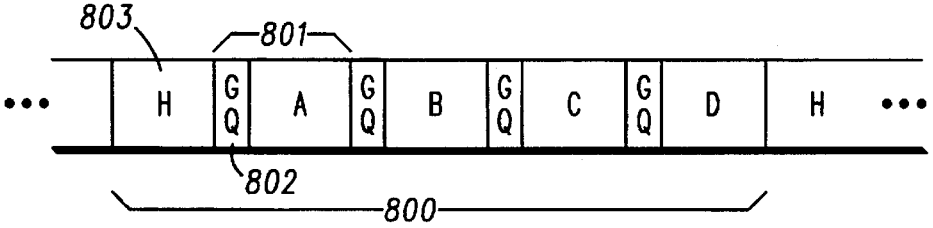
FIG. 8 comprises a depiction of a coding frame in accordance with the invention.

As depicted in FIG. 8, to frame (800) this information, the gain quantized information is represented by 5 bits (802) per subframe (801) as specified earlier. In addition, 5 bits are utilized per frame to represent an average energy value for the entire frame. Additionally, 2 bits are utilized per frame (800) to represent which of the four coding modes has been selected for use with the present frame. These bits, representing average energy and coding mode, are positioned in a header (803). The above developed gain quantized information, along with other speech coding parameters, is then further encoded and transmitted by the transmitter (105) described earlier in FIG. 1.

Figure 9:
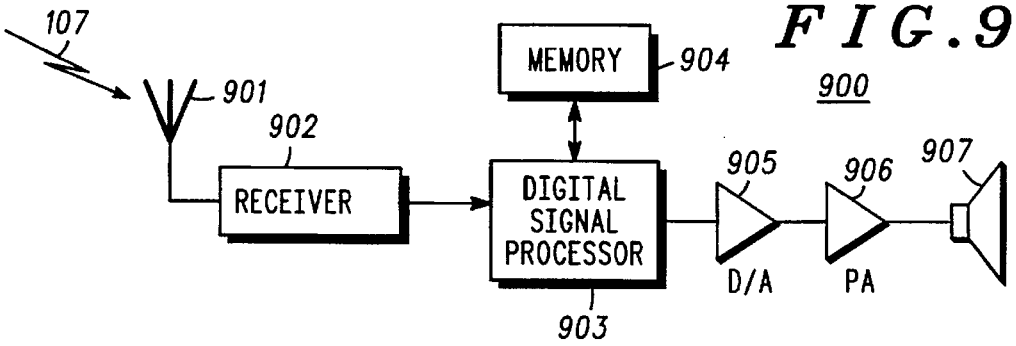
FIG. 9 comprises a block diagram of a speech coder and receiver in accordance with the invention.

Referring now to FIG. 9, an antenna (901) receives the transmitted signal (107) and a coupled radio receiver (902) demodulates the signal to recover the coding information. A digital signal processor (903), which includes an appropriate speech synthesis platform (as described above in FIG. 2), utilizes this coding information to synthesize a digitized representation of the original speech information. A digital to analog convertor (905) converts this digitized representation into analog form, which a power amplifier (906) then amplifies and a speaker (907) renders audible. Again, a memory (904) can be utilized to store programming information and other data utilized by the digital signal processor (903) to effectuate the synthesis process.

Figure 10:
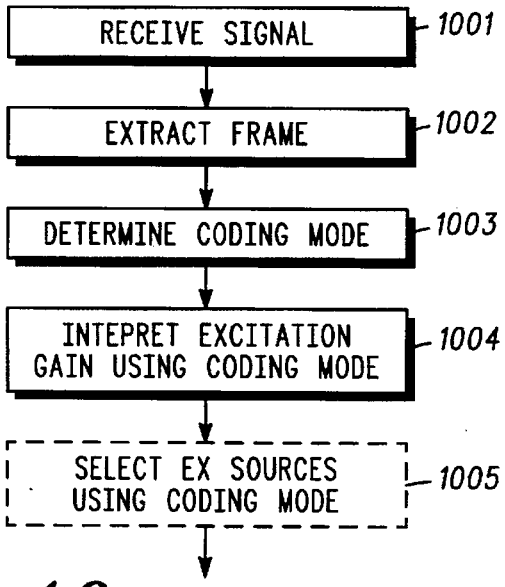
FIG. 10 comprises a flow diagram depicting processing in accordance with the invention.

Referring to FIG. 10, the platform described in FIG. 9 functions, as indicated, to receive the speech coded signal (1001) and to extract the speech coding information on a frame by frame basis (1002). By referring to the 2 bits in the frame that identify the coding mode, the receiver (900) can determine the coding mode (1003) and thereafter interpret the excitation gain information using the appropriate coding mode (1004). For example, if the coding mode indicated coding mode 3, and the excitation gain value represented index 22, the receiver would apply that index value to the information contained in the mode 3 information as described earlier to thereby determine the appropriate gain values to be utilized for the excitation sources.

As described earlier with reference to FIG. 2, in this particular embodiment, a plurality of VSELP codebooks (203–205) are provided, in addition to the long term prediction state (201). Also as noted earlier, in coding mode 1, the voice information constitutes a primarily unvoiced signal. Consequently, it may, in some applications, be advantageous to disable the long term prediction state (201) during a coding mode 1 frame, and reallocate the bits which would have been used by the long term prediction state (201) for an additional excitation codebook. For example, with reference to FIG. 2, in mode 1, the receiver could know, by prearrangement, to utilize VSELP codebooks 2 and 3 (204 and 205) to best accommodate a primarily unvoiced message, whereas modes 2–4 could indicate the use of the long term prediction state (201) and VSELP codebook 1 (203) excitation sources to better accommodate speech information containing at least a reasonable amount of voicing. Therefore, refering again to FIG. 10, the coding mode can also be used to indicate selection of particular excitation sources (1005).

Other methods of partitioning could of course be defined using the method outlined. Also, although the voicing classification is based on the open-loop prediction gain computed from the input speech, this does not preclude a closed-loop search of the long term prediction codebook at each subframe.

So configured, the intended benefits are obtained. The use of multiple coding modes reduces the number of bits required to represent an adequate variety of quantized gain values. Speech quality is maintained because an adequate quantity of gain quantizers are in fact provided. And lastly, the gain quantizer sensitivity to bit errors has been reduced, because if the bits specifying the voicing class are received correctly, errors in subframe gain bits result in a selection of a gain vector that still remains at least representative of its voicing class. In essence, the subframe gain bits are made less sensitive to bit errors, while the coding mode bits, introduced to specify the frame voicing mode, are more sensitive. This sensitivity trade-off works well because the subframe gain bits significantly outnumber the frame voicing mode bits by 10 to 1 in the described embodiment. Therefore, the voicing bits may be efficiently protected without unduly increasing the total number of bits required to represent the information.

What is claimed is:

1. A method for providing information, comprising the steps of:

A) providing a plurality of coding modes for speech coding an input speech segment, wherein at least two of the coding modes correspond to substantially voiced input speech signals;

B) selecting one of the coding modes as a function, at least in part, of periodicity of an input speech signal.

2. A method for providing speech coder excitation gain information, comprising the steps of:

A) providing information for a plurality of coding subframes related to periodicity of an input speech signal;

B) providing a plurality of coding modes for speech coding an input speech segment, wherein at least two of the coding modes correspond to substantially voiced input speech signals;

C) selecting one of the coding modes as a function, at least in part, of the periodicity of the input speech signal.

3. The method of claim 2, wherein the periodicity of the input speech signal tends to reflect a degree to which the input speech signal comprises a voiced input speech signal.

4. A method for providing information, comprising the steps of:

A) providing first information for a plurality of coding subframes related to pitch information corresponding to an input speech signal;

B) based upon the first information, providing second information for the plurality of coding subframes related to periodicity of the input speech signal;

C) providing a plurality of coding modes for speech coding an input speech segment, wherein at least two of the coding modes correspond to substantially voiced input speech signals;

D) selecting one of the coding modes as a function, at least in part, of the second information of the input speech signal.

5. The method of claim 4, wherein step B includes the steps of:

B1) using the first information on a subframe-by-subframe basis to develop error information;

B2) using the error information to develop the second information.

6. The method of claim 5, wherein step B1 includes the steps of:

B1*a*) using the first information on a subframe-by-subframe basis to develop a signal;

B1*b*) comparing the signal against a reference signal representing a subframe of the input speech signal to develop the error information.

7. The method of claim 5, wherein the error information developed in step B1 reflects a degree to which previously stored information correlates to a present signal.

8. The method of claim 7, wherein the present signal comprises a representative portion of the input speech signal.

9. The method of claim 4, wherein in step C at least one of the the plurality of coding modes corresponds to at least substantially unvoiced input speech signals.

10. The method of claim 4, wherein step C further comprises the steps of:

C1) providing a first coding mode that corresponds to a primarily voiced input speech signal;

C2) providing a second coding mode that corresponds to a primarily unvoiced input speech signal;

C3) providing at least a third coding mode that corresponds to an input speech signal that is neither primarily voiced or primarily unvoiced.

11. The method of claim 4, wherein the coding modes that correspond to substantially voiced input speech signals represent, via an index value, both:

A) that portion of decoding filter excitation that is due to long term prediction influence; and B) a scale factor to allow adjustment of an overall frame energy value for each coding subframe.

12. A method of transmitting speech coder excitation gain information, comprising the steps of:

A) providing a frame of speech coding information, which frame includes a plurality of coding subframes;

B) including in the frame an average energy value;

C) including in the frame a mode indicator to indicate which of a plurality of coding modes is presently being utilized, wherein at least two of the coding modes correspond to substantially voiced input speech signals;

D) providing in at least some of the coding subframes a gain value representing excitation gain information, which gain information is coded pursuant to the presently utilized coding mode.

13. A method of receiving speech coder excitation gain information, comprising the steps of:

A) receiving a signal;

B) extracting from the signal a frame of speech coding information, which frame includes a mode indicator to indicate which of a plurality of coding modes is currently being utilized, and a plurality of coding subframes, wherein at least some of the subframes include a value that represents excitation gain information;

C) determining from the mode indicator which coding mode is currently being utilized;

D) based upon the mode indicator, selecting a coding mode from amongst a plurality of coding modes, which plurality includes at least two coding modes that correspond to substantially voiced input speech signals, and using the selected coding mode to interpret the values.

14. The method of claim 13, and further including the steps of:

E) providing a plurality of excitation codebooks and at least one excitation source that represents pitch related information;

F) based upon the mode indicator, selecting at least two excitation sources from amongst:

the excitation codebooks; and the at least one excitation source that represents pitch related information.

* * * * *